US005351060A

United States Patent [19]

Bayne

[11] Patent Number: 5,351,060

[45] Date of Patent: Sep. 27, 1994

[54] ANTENNA

[76] Inventor: Gerald A. Bayne, Le Couvert Les Adrets-de-L'Esterel, 83600 Frejus, France

[21] Appl. No.: 840,498

[22] Filed: Feb. 24, 1992

[30] Foreign Application Priority Data

Feb. 25, 1991 [FR] France ..... 91 400507

[51] Int. Cl.[5] ..... H01Q 3/00

[52] U.S. Cl. ..... 343/766; 343/709; 343/757; 343/781 CA; 342/359

[58] Field of Search ..... 343/755, 757, 766, 781 CA, 343/781 P, 840; 342/140, 158, 359

[56] References Cited

U.S. PATENT DOCUMENTS

| | | | |
|---|---|---|---|
| 3,696,432 | 10/1972 | Anderson et al. | 343/757 |
| 3,745,582 | 7/1973 | Karikomi et al. | 343/758 |
| 4,173,762 | 11/1979 | Thompson et al. | 343/759 |
| 4,305,075 | 12/1981 | Salvat et al. | 343/781 CA |
| 4,675,688 | 6/1987 | Sahara et al. | 343/765 |
| 4,786,912 | 11/1988 | Brown et al. | 343/767 |
| 4,811,026 | 3/1989 | Bissett | 343/766 |
| 4,827,269 | 5/1989 | Shestag et al. | 343/766 |
| 5,194,874 | 3/1993 | Perrotta | 343/757 |

FOREIGN PATENT DOCUMENTS

| | | | |
|---|---|---|---|
| 0002982 | 7/1979 | European Pat. Off. . | |
| 0084420 | 7/1983 | European Pat. Off. . | |
| 0154240 | 11/1985 | European Pat. Off. . | |
| 0227930 | 8/1987 | European Pat. Off. . | |
| 0403684 | 12/1990 | European Pat. Off. . | |
| 1466380 | 2/1969 | Fed. Rep. of Germany . | |
| 0298183 | 12/1988 | Japan | 343/766 |
| 653464 | 5/1951 | United Kingdom . | |
| 934057 | 8/1963 | United Kingdom . | |
| 934058 | 8/1963 | United Kingdom . | |
| 1136174 | 12/1968 | United Kingdom . | |
| 1171401 | 11/1969 | United Kingdom . | |
| 1495298 | 12/1977 | United Kingdom . | |
| 2173643 | 10/1986 | United Kingdom | 343/766 |

*Primary Examiner*—Donald Hajec
*Assistant Examiner*—Tan Ho
*Attorney, Agent, or Firm*—Richard M. Goldberg

[57] ABSTRACT

A satellite television receiver antenna for use on sea-borne vessels comprises a Cassegrain antenna including a parabolic main reflector, and a hyperbolic sub-reflector mounted at an angle slightly opposite from the center axis of the parabolic reflector, the sub-reflector being driven by a motor to rotate so as to cause the antenna reception pattern to perform a conical scan around the main axis of the parabolic reflector. The rotational speed is an even multiple of the frequency of any amplitude modulation of the received signal, or of any electrical interference, and the received signal is measured at points rotationally spaced apart 180 degrees, so that the effects of modulation and/or electrical interference are cancelled. The measured signal strength at four positions spaced rotationally by 90° is used to derive power signals to drive pulse width modulation control azimith and elevation motors.

12 Claims, 14 Drawing Sheets

CONICAL SCAN
SATELLITE
RECEIVED SIGNAL CONSTANT

0°
90°
180°
270°

SIGNAL
0°
180°
360°

ANTENNA AXIS MISALIGNED
SATELLITE
RECEIVED SIGNAL VARIES

0°
90°
270°

SIGNAL
0°
90°
180°
270°
360°

PRIMARY FOCUS

ANTENNA

FIELD OF THE INVENTION

This invention relates to an antenna; particularly to a receiver antenna of the type which includes means for producing a rotation of the antenna pattern and uses the received signal, modulated by the rotation, to derive a control signal to track the received signal source. Antennas of this kind are known as "conical scanning" antennas, because the beam pattern rotates around the surface of a cone (the apex being at the antenna).

BACKGROUND ART

Conical scanning antennas were first applied in radar tracking of targets (the antennas acting both to transmit and to receive but generally scanning the transmitted beam). More recently, conical scanning antennas have been employed as ground station antennas for satellite telecommunication links tracking non geo stationary satellites.

A particular problem occurs when an antenna is mounted on a vessel at sea, since a vessel is subject to endless rolling, pitching and yawing motion due to the normal swells and tides and to the wakes of other passing vessels. It is not unusual for a small boat to roll through 50 to 60 degrees; the period of the roll is variable, but is on the order of ten seconds or so. The problem is of course exacerbated for smaller pleasure craft (which generally try to avoid extreme conditions).

For a water vessel (or other vehicle) to receive satellite communications it is therefore necessary that the receiver antenna be controlled to point at the satellite. Most seaborne satellite antennas are either gimballed or are mounted on drive motors which are responsive to sensors sensing the motion of the ship. An example of such an antenna is shown in EP0154240. Such arrangements are however mechanically complex and expensive. It is also known to mount an antenna on a gyro stabilized platform, but this limits the antenna size and weight since the capacity of such platforms are restricted.

Another problem with such arrangements is that the antenna is maintaining its orientation relative to the vessel or vehicle. However, when the vessel moves to a different geographical location, the relative inclination required to point at the satellite changes and consequently the antenna is mis-aligned.

These problems make such antennas unattractive for application as vehicle-borne receiver antennas for satellite television, where a simple, robust and inexpensive antenna is essential.

SUMMARY OF THE INVENTION

In one aspect, the invention therefore provides a water vessel comprising a satellite television receiver antenna which employs conical scanning. Such an antenna may receive Direct Broadcast by Satellite (DBS) signals, or other television formats (for example the transmission format used by the Astra Satellite).

Another problem encountered in providing a tracking antenna for satellite television reception is that the received signal may be strongly periodically amplitude modulated; for example, a triangular envelope, typically harmonically related to the line or frame period, may be imposed on the FM carrier. This modulation interferes with the signal derived from conical scanning. In a further aspect of the invention, there is therefore provided a conical scanning antenna which employs a scan frequency harmonically related to the above signal modulation frequency; this enables this signal modulation to be taken account of.

Preferably the scan frequency is a sub-harmonic of the modulation frequency, and the arrangement is such that a signal is derived as the difference of received signal samples separated in time by an integer number of modulation periods so that the effect of the modulation signal on the satellite tracking is cancelled.

Similarly, where power for the antenna is derived from an AC power supply such as the 50 hertz or 60 hertz mains, a mains ripple may be super imposed at various points in the scanning system. In another aspect of the invention, therefore, the scanning frequency is arranged to be harmonically related to the power supply frequency, and preferably to be a sub-harmonic of it, as above. Where the movement of the ship can be expected to be lively, and the antenna response must therefore be particularly rapid, the scan frequency must also be increased. If a scan frequency that is a harmonic of any signal modulation is used, the latter may be easily reduced or eliminated by filtering at a later stage. Any mains ripple that may be present will be seen as a slight offset of the antenna if the scan frequency and the mains frequency are the same. In any event, where, ( as in the above aspects of the invention), the scanning frequency is to be harmonically related to an external modulation frequency, close control over the scanning frequency is also essential. The triangular wave form envelope observed in satellite television signals is usually at the frame rate of the television signal (25 or 30 hertz) and the AC mains power supply is generally 50 or 60 hertz; the scan frequency of the antenna will therefore be a sub multiple, or a multiple, of the external modulation frequency.

Where the conical scanning is effected by mechanical rotation of an element of the antenna it is difficult to maintain close position and rotational speed accuracy, especially at low speeds, especially where the element is small and consequently has a low angular momentum and mechanical inertia. Known techniques, for example employing a phase locked loop, are often unstable under these conditions.

According to a further aspect of the invention, there is therefore provided a rotary speed control system comprising a rotary position signal generator generating a periodically varying signal including a constant average level related to the rotary speed, and a reference signal generator generating a corresponding signal, further comprising comparator means arranged to generate an output corresponding to the difference between said signals, whereby when the rotary speed approximates a desired speed said comparator means generates a pulse width modulated output arranged to stabilize said rotary speed, and when said rotary speed diverges substantially from desired speed said comparator output varies to adjust said rotary speed.

Preferably such a system is employed to control the scan speed of a rotated sub-reflector.

In general, a conical scan can be produced either electrically (by varying electrical parameters of the antenna) or mechanically (by rotating a component of the antenna). It is known to provide an antenna with an off-set feed and rotate the feed around the central axis of the antenna. One type of antenna employed for satellite television reception is the Cassegrain reflector antenna, which comprises a parabolic dish focusing the received signal onto a secondary reflector, or sub-reflector, having a hyperbolic profile, which refocuses the signal onto a feed, located in the centre of the parabolic reflector. GB1136174 shows a Cassegrain antenna for producing a transmitted scanned elliptical beam in which the sub-reflector is mounted axially aligned with the parabolic antenna axis, but is eccentrically mounted with respect to that axis. However, when the sub-reflector has an appreciable weight and is rotated at an appreciable speed, this arrangement can lead to undesirable mechanical vibration of the whole antenna since the center of gravity of the sub-reflector is oscillating, reducing the accuracy of the positioning and the lifetime of the antenna.

In a further aspect of the invention, therefore, we provide a Cassegrain antenna for conical scanning in which the sub-reflector is mounted to rotate about its center of gravity substantially on the main axis of the main reflector, but the main axis of the sub-reflector is angularly misaligned with that of the main reflector. This arrangement produces a conical scan but with no substantial mechanical vibration as a result.

The above aspects of the invention make it possible to provide an antenna which directly tracks the satellite and consequently is correctly aligned irrespective of movement of the vehicle or vessel upon which the antenna is mounted, providing good accuracy whilst employing a relatively simply and inexpensive construction.

Other aspects and preferred features of the invention will become apparent from the following description and appended claims.

BRIEF DESCRIPTION OF THE DRAWINGS

The invention will now be illustrated, by way of example only, with reference to the accompanying drawings in which.

GENERAL DESCRIPTION OF CONICAL SCANNING

Figure 1:
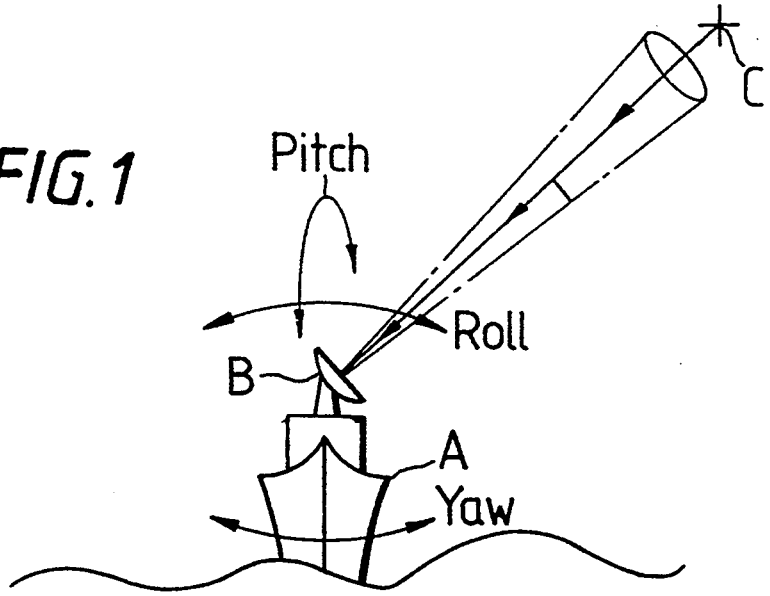
FIG. 1 shows schematically a water vessel including a satellite receiver antenna.

Referring to FIG. 1, there is a water vessel comprising a hull A upon which is mounted a satellite reception antenna B directed towards a geo stationary satellite C. The antenna B effectively receives the signal from the satellite C provided the satellite C lies within the effective angular beam width of the antenna, which is defined by the antenna geometry and its operating frequency. It is usually quoted as the half power beam width, given as 57.3 L/D°, where L is signal wave length and D is antenna diameter. The hull A and antenna B are subject to rolling motions in three dimensions, namely pitching (fore and aft rotation), rolling (side to side rotation about a horizontal axis) and yawing (side to side rotation about a vertical axis). The magnitude of any one of these motions is sufficient normally to cause the antenna B to lose the signal from the satellite C over portions of each movement, thus perodically disrupting the received signal.

Figure 2:
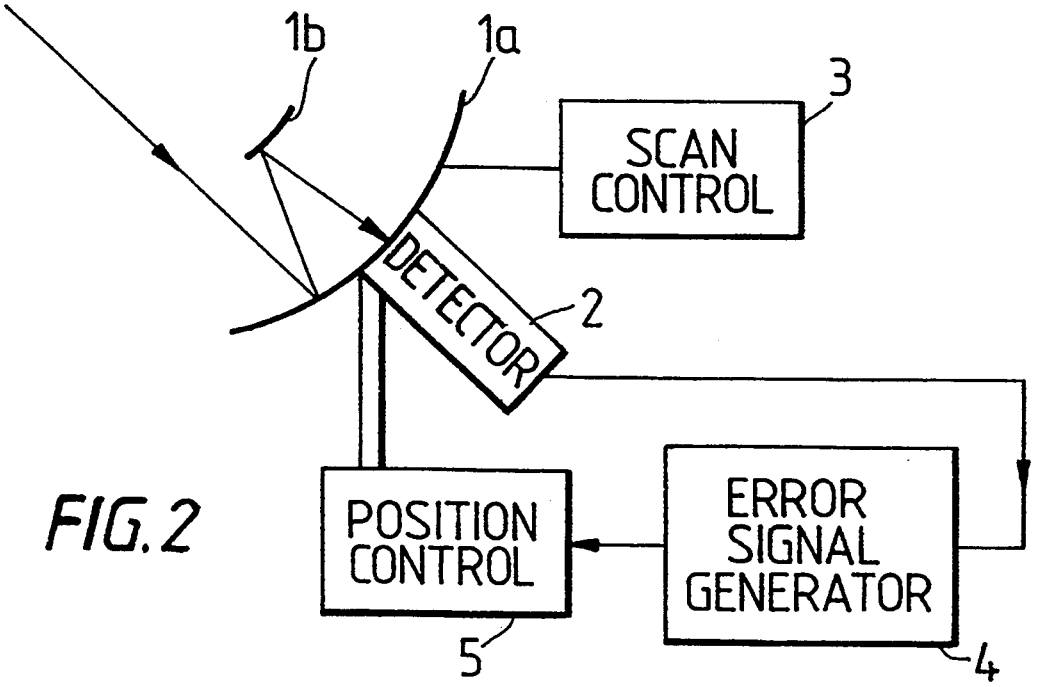
FIG. 2 shows schematically the general structure of a conical scanning antenna.

Referring to FIG. 2, in general a conical scan antenna comprises an antenna body 1 (shown as a cassegrain antenna comprising a main reflector 1*a* and a sub-reflector 1*b*), a detector 2 receiving the signal acquired from the antenna 1, a scan control generator 3 modifying the antenna properties to produce a conical scan antenna beam pattern, an error signal generator 4 receiving a signal from the detector 2 and generating, in response to this signal and to the angular position of the antenna 1, an error signal or signals which indicate the mis-alignment of the antenna with its target satellite, and a position control drive 5 receiving the error signal from the error signal generator 4 and modifying the position of the antenna 1 so as to reduce the magnitude of the error signal and hence improve the alignment of the antenna.

Figures 3A, 3B, 3C, 3D, 3E, 3F:
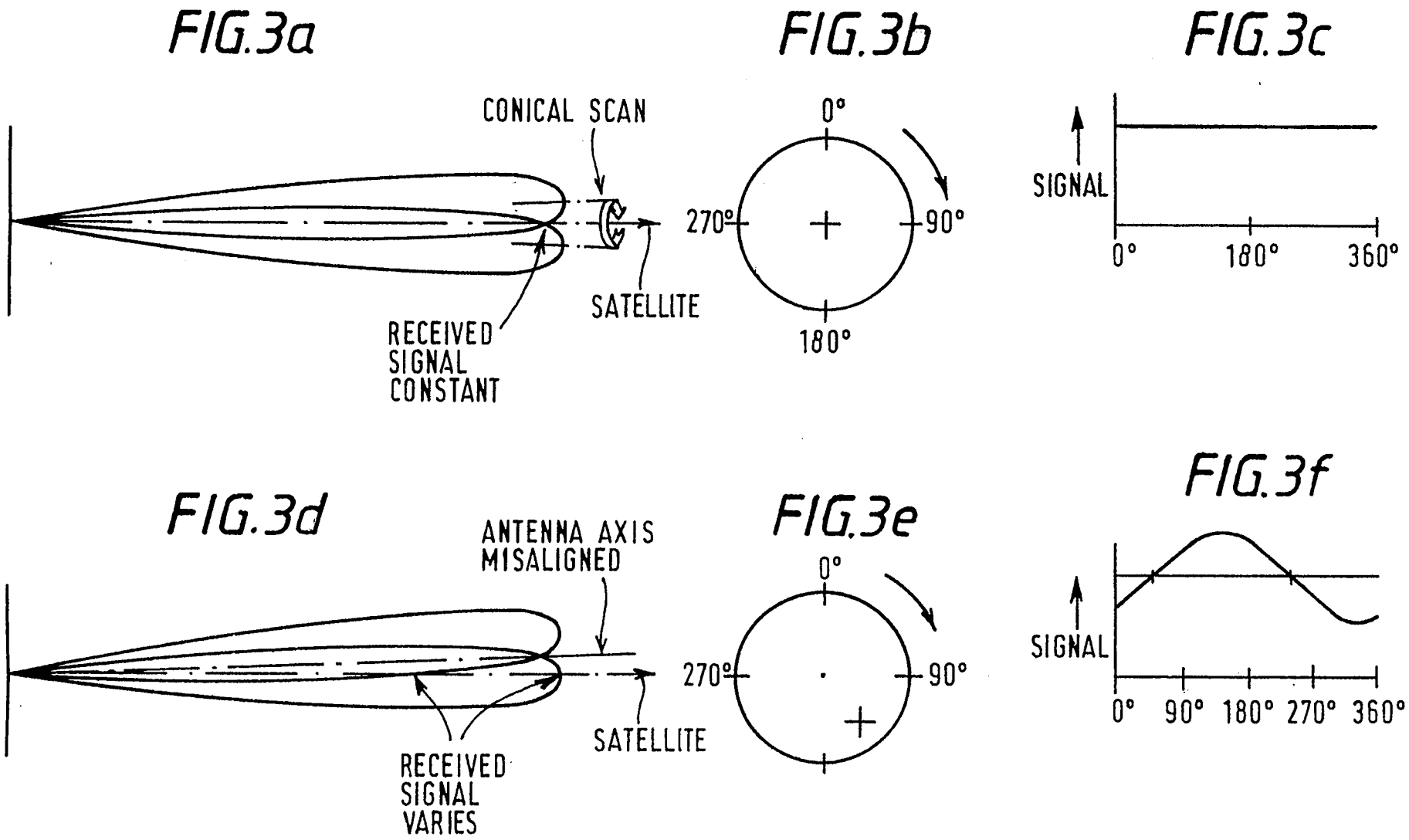
FIGS. 3*a* to 3*f* illustrate the principal of conical scanning.

Refering to FIG. 3*a*, the conical scan produces a small angular mis-alignment between the center of the antenna beam pattern and the central axis of the antenna body 1, and rotates the antenna beam pattern so that the direction of mis-alignment rotates. Referring to FIG. 3*b*, when the main reflector 1*a* is directly aligned with the satellite, the view from the main reflector 1*a* would notionally show the center of the antenna beam pattern rotating symmetrically about the satellite position so that the degree of mis-alignment with the satellite is equal through each rotation, and consequently the strength of the signal received from the satellite is constant as shown in FIG. 3*c*.

Referring to FIG. 3*d* if the satellite is not aligned with the central axis of the main reflector 1*a* (due, for example, to rolling of the vessel), then as shown in FIG. 3*e* the degree of mis-alignment or eccentricity between the antenna beam pattern and the direction of the satellite has a minimum (when the satellite is most closely approached) and a maximum, and consequently, as shown in FIG. 3*f* the strength of the signal received from the satellite is modulated by a periodic variation, the amplitude of which corresponds to the degree of mis-alignment between the antenna and the satellite, and the phase of which indicates the direction of mis-alignment of the antenna.

The antenna could thus be exactly aligned by extracting the amplitude and phase of this signal strength variation and employing these as position setting signals to exactly align the antenna; or alternatively, amplitude and phase or related (eg quadrature) signals can be extracted and employed as feed back control signals for a position control system seeking to continually reduce or minimize the mis-alignment (rather than to produce completely correct alignment).

ANTENNA CONSTRUCTION

Figure 4:
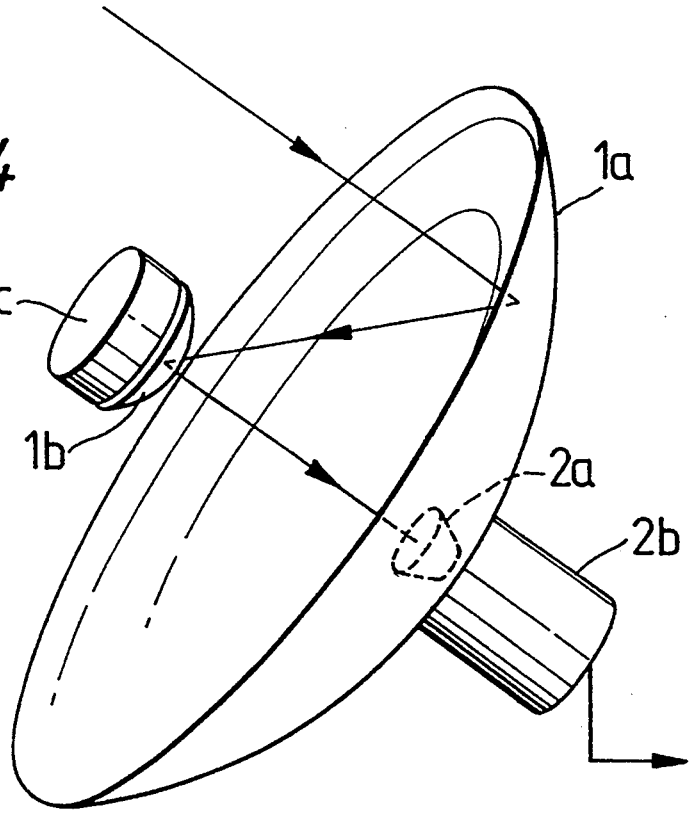
FIG. 4 shows schematically a cassegrain receiver antenna.

Refering to FIG. 4, in this embodiment the antenna 1 comprises the main reflector 1*a* consisting of a dish having a paraboloid profile; such dishes are commonly produced from aluminium or other metals by spinning and are available in a range of sizes. A diameter of 0.5–2 meters (eg. 90 cm) is generally adequate for reception.

The secondary reflector, or sub-reflector, 1*b* has an essentially hyperboloid reflector surface, and is mounted on a support structure ie positioned so that the focal point of its hyperboloid surface lies at the focus of the parabolic reflector 1*a*. An incoming signal is thus reflected from the surface of the main reflector 1*a*, off the surface of the secondary reflector 1*b*, which is focused upon a feed horn 2*a* at the center of the main reflector 1*a* acting as the signal receiver. The feed horn 2*a* is coupled to a commercially available radio frequency down convertor 2*b*. Preferably two convertors are provided, for respectively horizontal and vertical polarizations, to allow two different signals to be watched on two separate television sets.

Following the down convertor 2*b*, a signal strength measuring circuit is provided which produces an output corresponding to the amplitude of the envelope of the signal; where a television or radio tuner is provided it may be convenient to utilize the automatic gain control (AGC) signal output, but any other convenient circuits such as a diode mixer circuit or other type of envelope detector could be employed.

The dimensions and shape of the secondary reflector 1*b* and of the feed horn 2*a*, are determined within the constraint that the received signal must focus into the feed horn 2*a*. The secondary reflector 1*b* needs to be wide enough to receive substantially all the signal from the primary reflector 1*a* so as to maximize the strength of the signal focused onto the feed horn 2*a*, but on the other hand the wider the secondary reflector 1*b* becomes, the more it blocks the aperture of the main reflector 1*a*. Such blockage is inevitable, however, to some extent because of the supporting structure 1*c* behind the sub-reflector 1*b* (which include a scan motor as discussed below). Similarly the feed horn 2*a* should be small enough to remain in the shadow cast by the sub-reflector 1*b* so as not to interfere with the reflecting system, but ideally wide enough to receive the entire beam width from the sub-reflector 1*b*. These parameters are easily determined from the dimensions of the primary reflector 1*a* and the supporting structure 1*c*, and a sub-reflector 1*b* of an appropriate size and profile is easily produced, for example, by turning a metal blank on a lathe.

Figure 5:
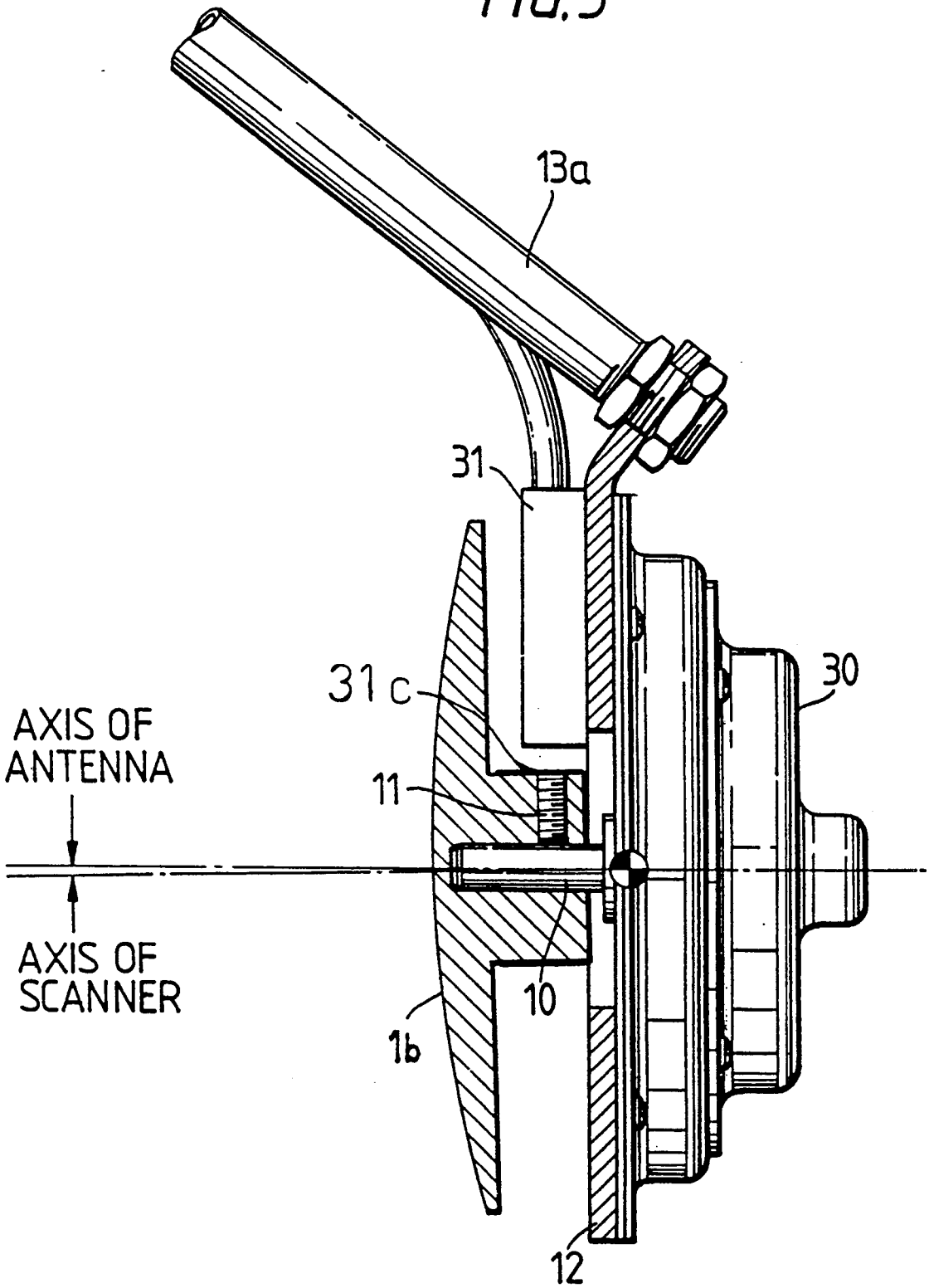
FIG. 5 shows schematically the sub-reflector of an antenna of one embodiment of the invention.

Referring to FIG. 5, in this embodiment, the sub-reflector 1*b* comprises a mushroom shaped metal component the upper surface of which is machined to a hyperbolic profile. An axial blind bore runs into the stalk or shaft of the sub-reflector 1*b*. The bore does not follow the axis of the subreflector 1*b* exactly; instead, it is arranged so that when mounted upon a spindle 10 supported on the support structure 1*c* and co-axial with the axis of the main reflector 1*a*, the focii for the two reflectors 1*A*, 1*b* co-incide (shown with the "o" symbol in FIG. 5) and the axis of the sub-reflector 1*b* diverges from that of the main reflector 1*a* by a small angle which determines the angle of mis-alignment of the conical scan. The angle of mis-alignment is to some extent a compromise between the effectiveness of the scanning (which favours a large mis-alignment) and the effectiveness of the antenna as a receiver (which is inevitably degraded since the antenna is never ideally aligned). It is found that a scan angle of around the theoretical antenna half power beam width (that is, the angular width around the main antenna axis at which the received signal strength falls to half the value received on the main antenna axis) is suitable. For example, with an antenna half power beam width of 1.7° the angle of mis-alignment could be 0.5° to 0.75°.

SCAN GENERATION AND CONTROL

Figure 6:
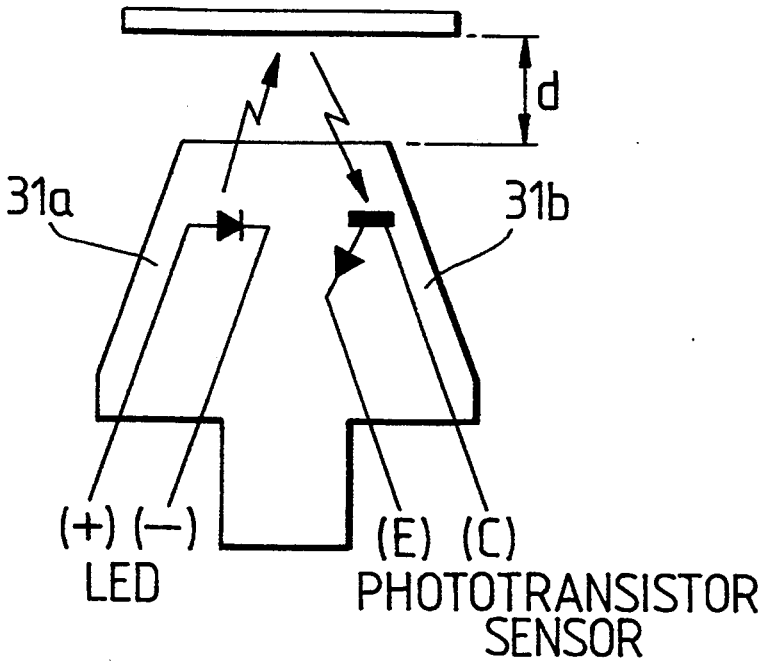
FIG. 6 shows schematically the electrical components of a sensor in FIG. 5.

The elements comprising the scan control 3 of FIG. 2 in this embodiment will now be explained referring to FIGS. 5 and 6.

The sub-reflector 1*b* is secured to the spindle 10 by a grub screw 11 screwed through a bore in the reflector 1*b* to contact the spindle 10. A mounting plate 12 is connected by three legs 13*a* (only one leg 13*a* is shown) to the main reflector 1*a*. The spindle 10 running through the mounting plate 12 is an extension of the shaft of a DC motor 30 which consequently rotates the sub-reflector 1*b* and thereby causes its axis, and the beam pattern of the antenna as a whole, to revolve around the axis of the reflector 1*a*.

Also mounted upon the mounting plate 12 is a sensor 31 aligned with the shaft of the sub-reflector 1*b*. In the present embodiment, the sensor 31 is responsive to the angular position of the sub-reflector 1*b* and is conveniently provided by an optical encoder; for example, the Radio Spares reflective opto switch 2601 which comprises an infra-red light emitting diode (LED) 31*a* and photo transistor 31*b* arranged so that a reflective surface at a distance from the device reflects radiation emitted from the LED 31*a* to the photo transistor 31*b* which provides an output photo current, as shown in FIG. 6.

A reflective position defining mark 31*c* is provided on the sub-reflector 1*b*; conveniently, this is a strip of adhesive reflective tape of a length sufficient to cover half the circumference of the shaft of the sub-reflector 1*b* such that the output of the sensor 31 is high for half each rotational cycle and low for the other half.

The DC power supply to the sensor 31 and DC motor together with the output line from the sensor 31 are routed via a cable along one of the support legs 13*a*.

Figure 7:
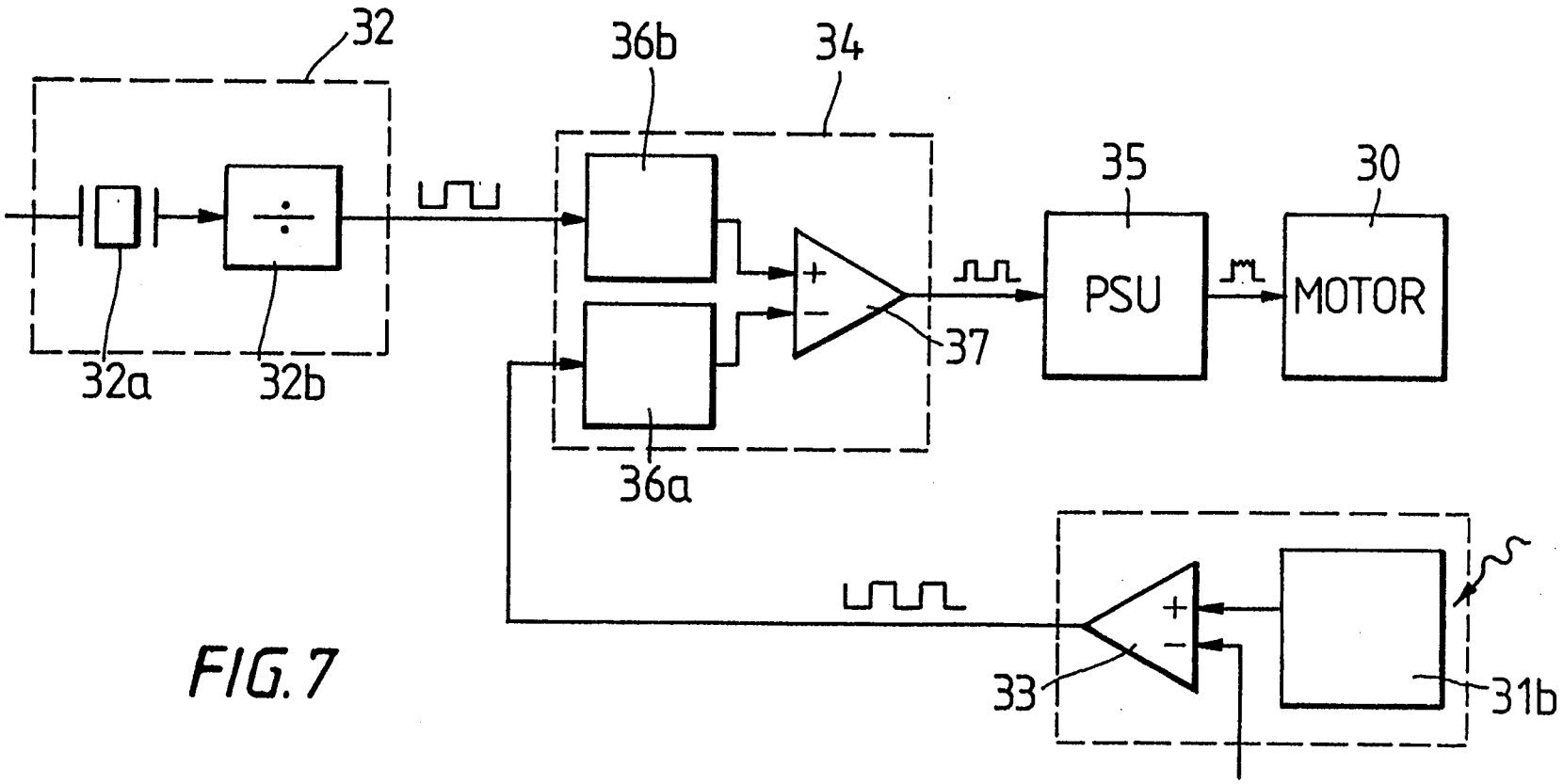
FIG. 7 shows schematically the electrical circuit used to rotate the sub-reflector of FIG. 5.

Referring to FIG. 7, the electrical circuit for driving the scan motor 30 to rotate the sub-reflector 1*b* and produce a concical scan comprises a reference frequency generator circuit 32 generating a stable signal at the frequency at which the motor 30 is to rotate.

Where the scanning frequency is to be harmonically related to the mains power supply frequency, it would be possible to derive the reference signal from the mains supply, but AC power supply generators for use on small boats often do not generate a stable supply frequency, however, and so in this embodiment it is preferred to employ a crystal oscillator 32*a* running at some convenient frequency (for example 3.2768 Mega-Hertz) and a digital pulse divider circuit 32*b* producing an output pulse every N input pulses, where N is the dividing ratio (for example $2^{18}$, or 262144 in this case). The divider circuit 32*b* may for example comprise commercially available counter-timer integrated circuits. One suitable arrangement comprises an M706BI (divide-by-$2^{16}$) circuit followed by a 4013 dual flipflop device. The output of the reference signal generator circuit is therefore a square wave signal at a frequency of 12.5 hertz, as shown in FIG. 8*d*.

Figure 8:
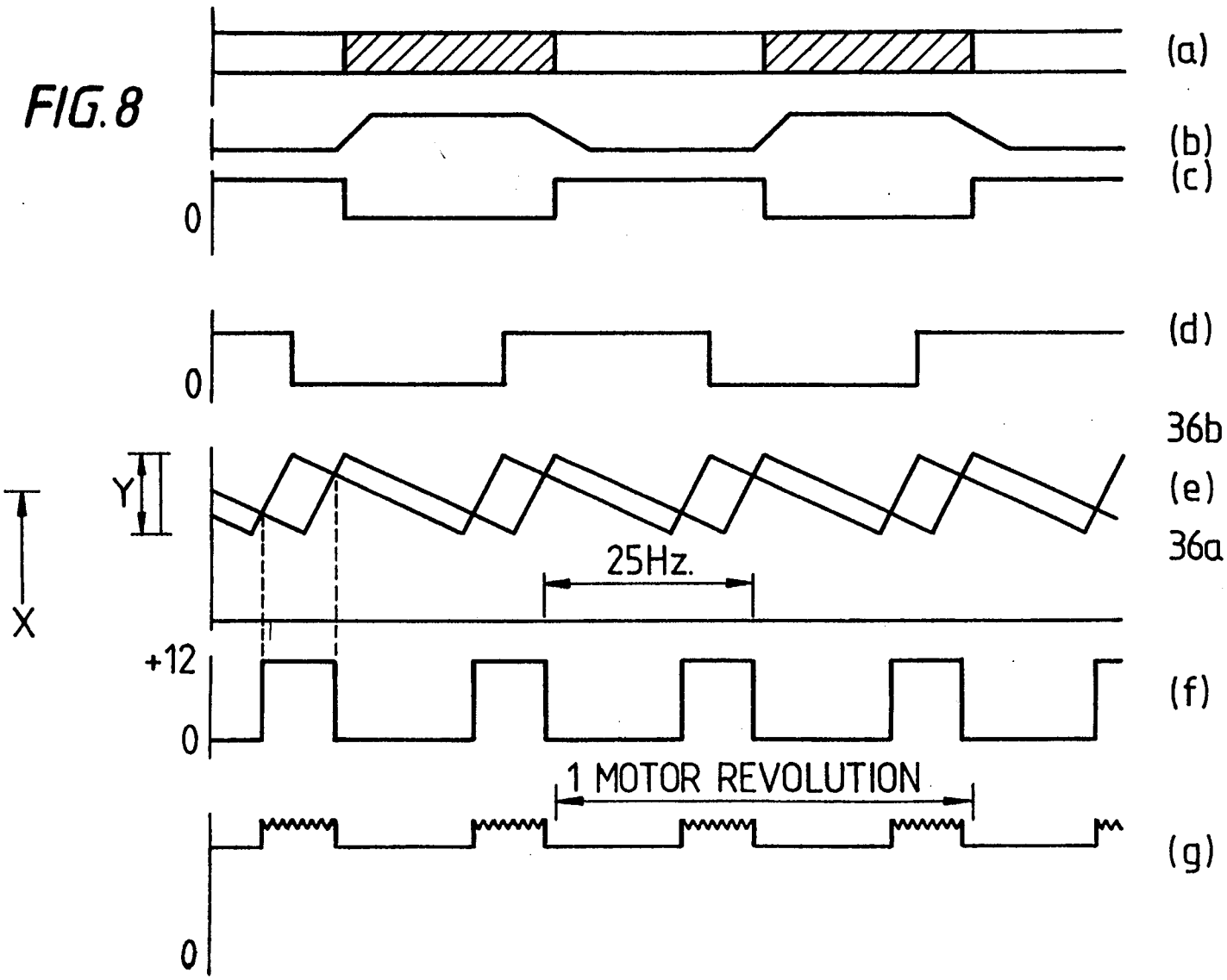
FIG. 8 shows schematically a wave form occuring at points in the circuit of FIG. 7.

The output of the optical sensor 31*b* when the sub-reflector 1*b* is rotating alternates between a high and low level depending on whether the dark or reflective areas, respectively, of the shaft of the sub-reflector 1*b* are facing the sensor 31; corresponding optical inputs to the sensor 31 and electrical outputs of the sensor 31*b* are indicated respectively in FIGS. 8*a* and *b*. The transition between high and low levels in FIG. 8*b* is of finite width due to the finite aperture of the sensor 31, and the output of the photo sensor 31*b* is therefore supplied as an input to a comparator 33 the other input of which is supplied with a reference threshold line between the high and low output levels of the the photo sensor 31*b*. The comparator 33 may be an operational amplifier acting as an inverting comparator. The output of the comparator 33 is therefore a train of square pulses at the frequency at which the sub-reflector 1*b* is actually rotating.

A control circuit 34 receives the reference signal at the desired frequency and the sensor signal (output by the comparator 33) indicating the actual frequency and phase of the rotation of the sub-reflector 1*b*, and generates a control signal to control a power supply 35 feeding the motor 30 so as to bring the actual rotational speed towards the desired rotational speed.

The power supply 35 is conveniently a switched mode power supply acting as a voltage follower arranged to deliver a power output, for example from a 12 volt DC power source to the motor 30 on receipt of a switching signal. The control circuit 34 operates as follows. The reference pulse train and the sensor pulse train are each supplied to a signal conversion circuit which produces, in response, an output signal having two components; a DC component related to the frequency of the input pulse train and a small AC component superimposed thereon. FIG. 8*e* shows two signals of this type, the magnitude of the DC component (not to scale) being indicated as X and that of the AC component being indicated as Y.

One suitable convertor device is provided by the Radio Spares IC 2917 tachometer integrated circuit, which comprises essentially a frequency to voltage converter providing an output DC level X proportional to the input frequency. A small, AC ripple (approximately saw tooth in shape, as shown in FIG. 8*e*) of magnitude Y and frequency double the input frequency also occurs as a result of a charge pump within the device responding to each zero crossing in the input signal. To generate zero crossings, a capacitor (not shown) is positioned in the signal path prior to the input to each tachometer. In the prior art, this ripple is viewed as undesirable. However, in this embodiment, the ripple is utilised as follows.

As shown in FIG. 8*e* while the two input signals are at approximately the same frequency, the DC levels of the corresponding outputs of the two signal convertors 36*a*, 36*b* will be approximately the same and consequently the two output signal levels will cross at four points within each 12.5 hertz cycle. When the two frequencies differ, however, to an extent causing a difference in DC components X greater than the magnitude Y of the AC ripple the two, signal levels will not cross at all.

Figure 9A:
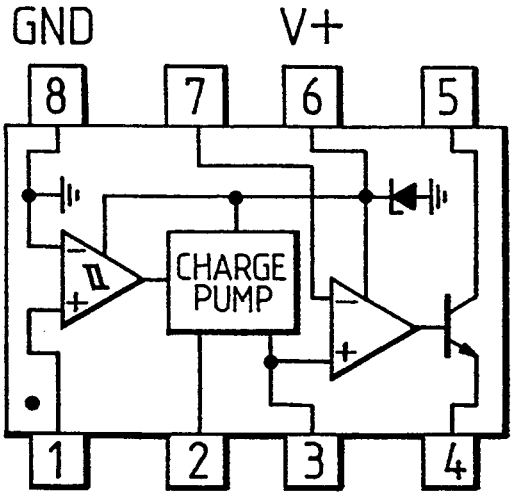
FIG. 9*a* shows schematically an embodiment of a component of FIG. 7.

A comparator 37 (typically comprising an operational amplifier followed by a transistor acting as an inverting comparator), as shown in FIG. 9*a* receives the two outputs of the two signal convertors 36*a*, 36*b* and generates a high output while the magnitude of the signal from the reference frequency signal convertor 36*b* is greater than that from the sensor signal convertor 36*a*. Accordingly, if the motor revolution frequency is much slower than the reference frequency, the output from the reference signal convertor 36*b* is always higher than that of the sensor signal 36*a* and consequently the output of the comparator 37 is permanently high, causing the power supply 35 to permanently supply power to the motor 30 which consequently accelerates rapidly.

On the other hand, when the rotational frequency of the sub-reflector 1*b*, and consequently the pulse frequency of the signal from the sensor 31*b*, is considerably higher than that of the reference signal frequency the DC level of the output of the sensor signal convertor 36*a* is sufficiently high that it remains permanently above the level of the output of the reference signal convertor 36*b* and consequently the output of the comparator 37 remains low, so that the power supply unit 35 supplies no power to the motor 30 which consequently rapidly decelerates.

As a result either of such an acceleration or such a deceleration, inevitably the levels of the outputs of the two signal convertors will approximately co-incide, and, as shown in FIG. 8*e*, resulting in the comparator producing a series of output pulses having a width corresponding to the degree of overlap between the two signals (or, more precisely, to the time for which the reference frequency signal level is above the sensor signal level). Should the rotational frequency of the sub reflector 1*b* momentarily drop, the arrival of the zero crossings of the output of the comparator 33 is delayed and consequently the corresponding output of the signal convertor 36*a* will be delayed, resulting in an increase of the width of the output pulses from the comparator 37 and consequently an immediate increase of power supply to the motor 30 to restore the rotational speed. Likewise, a rise in rotational speed causes a decrease in the width of the output pulses of the comparator 37 and consequently a reduction of the power supplied to the motor 34.

This type of speed control operates almost instantaneously, twice within each rotional cycle. Should the rotational speed deviate from the reference frequency by more than a few cycles, the DC levels of the two signals differ to the extent that the signal levels do not overlap and the output of the comparator 37 stays high to accelerate the motor 30 to bring the rotational speed back to the reference frequency.

Figure 9B:
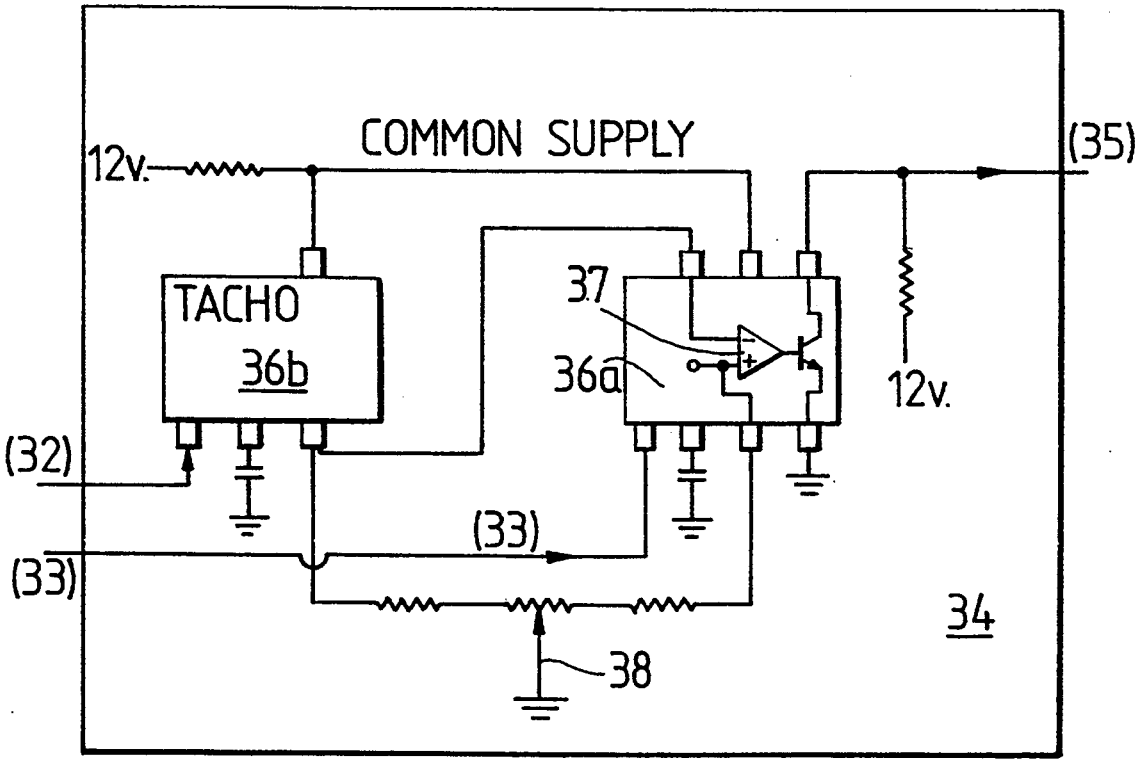
FIG. 9*b* shows the arrangement of two such components in the circuit.

Referring to FIGS. 9*a* and 9*b*, the above referenced Radio Spares IC 2917 tachometer device includes a comparator. The circuit 34 thus comprises two such devices, the output of one 36*b* being supplied to the input of the comparator 37 of the other. The other input of the comparator 37 is connected to the output of its own tachometer 36*a*.

The two signal levels are set such that they overlap at the desired motor speed by a potentiometer circuit 38.

One embodiment of the invention using such devices therefore provides power to the motor 30 as a pulse width modulated signal when the motor frequency lies within a predetermined band (eg ±2%) around the reference frequency, and when the frequency lies outside this band, supplies power at either a 100% duty cycle to accelerate the motor or zero percent to decelerate the motor. Use of this type of device therefore provides fine control of the motor when it is close to the desired frequency and rapid acceleration or deceleration of the motor when it is far from the reference frequency.

Other advantages accrue from this embodiment of the invention; firstly, because the signal conversion device is responsive to the input signal frequency and zero crossings it is relatively insensitive to the shape or absolute level of the input signals, and two devices 36*a*, 36*b* of the same type will produce a similar output signals even in response to differing input signals. Secondly, by employing a pair of devices of the same type supplied from a common power supply, the effects of temperature variations (which can be quite marked when the antenna is mounted outdoors on a water vessel) are substantially the same on the output of each device and are thus eliminated at the comparator 37; much the same is true of other extraneous or intrinsic factors causing drift or variation in the counter devices.

CONTROL SIGNAL GENERATION

The operation of the control signal generator 4 will now be discussed in greater detail. Briefly, the control signal generator 4 operates to sense the magnitude of the received signal at predetermined antenna orientations, and uses these to derive error signals indicating the mis-alignment of the antenna.

The first requirement is therefore to accurately determine the angular position of the antenna beam. This could be determined in a number of ways; for example, a further optical encoder could be provided associated with the sub-reflector 1*b*. It is however economical and convenient to employ the existing optical encoder 31 to provide a positional signal as well as a rotational speed signal. However, since the optical encoder 31 produces only one pulse per rotation of the sub-reflector 1*b*, it is necessary to further process the output to derive position signals for a plurality of rotational positions.

It would be possible to provide, instead of a single reflective area 31*c*, a plurality of radially distributed reflected bands. However, this is in practice not as convenient as providing a single detachable reflective strip 31*c* since it is harder to align a plurality of reflective areas accurately.

Accordingly, in this embodiment, a plurality of position signals are generated by interpolation from the optical encoder 31.

A phase locked loop is well known to comprise a controllable oscillator, the control signal for which is supplied from the output of a phase detector or (for example multiplier) circuit comparator. The phase detector receives an input signal and a reference signal and generates the control signal as a function of the phase of the input signal relative to the reference signal. The reference signal is supplied from the output of the controlled oscillator. If the phase of the input signal changes, a change will occur in the control signal, altering the frequency of the controlled oscillator. If the frequency of the input signal changes, a phase shift occurs and the control signal changes in such a manner as to vary the frequency of the oscillator to cause the reference signal to follow the input signal.

Figure 10A:
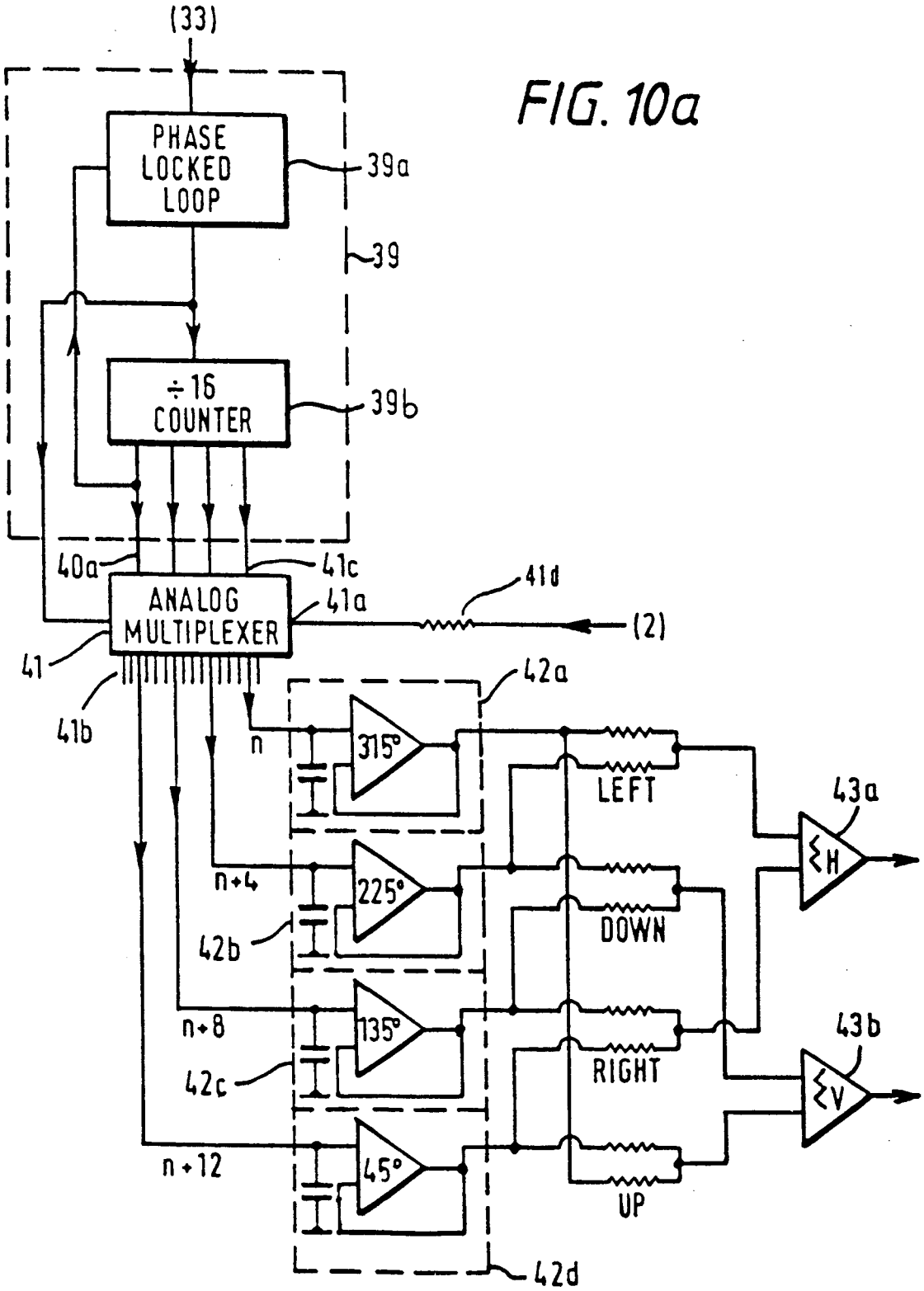
FIG. 10*a* shows schematically the control circuit used to generate an error signal to position the antenna in one embodiment of the invention.

Accordingly, referring to FIG. 10*a*, the output of the comparator 33 is processed by a rotational positional signal generator 39 comprising a phase locked loop 39*a* (for example a 4046 device) the oscillator of which is set to run at a frequency a multiple of the desired rotational frequency of the sub-reflector 1*b* or, in other words, the frequency of pulses received from the comparator 33. Preferably the multiple is a power of 2; for example, 16. Thus, for a scan frequency of 12.5 hertz, the phase lock loop oscillator is set to run between around 150 and 250 hertz depending upon the control voltage applied.

The output of the voltage controlled oscillator of the phase lock loop 39*a* is supplied to a counter circuit 39*b* (responsive, for example, to positive or rising edges in the oscillator output). The counter circuit 39*b* is advantageously one of the many commercially available flip flop devices; for example a 4 bit continuously circulating counter which generates in response to successive inputs each successive binary digit between zero and fifteen.

The number to which the counter 33*b* counts before recirculating is related to the ratio of the phase lock loop frequency to the frequency input from the comparator 33; in a simple case the two are equal so that the counter or divider 39*b* counts through its range once each rotation of the sub-reflector 1*b*. The state of the highest order bit output line 40*a* from the counter 39*b* therefore changes at the same frequency as the signal input to the phase locked loop 39*a* from the comparator 33, and is fed back to the phase detector or multiplier of the phase locked loop 39*a* to provide the reference signal for the phase locked loop. The state of the lowest order bit in this embodiment changes at half the phase locked loop frequency.

The output of the phase locked loop 39*a* therefore tracks variations in the rotational speed off the sub-reflector 1*b* as they occur whilst maintaining a fixed phase relationship with the rotational position of the sub-reflector 1*b* at the correct rotational speed.

The digital output of the counter 39*b* therefore directly represents the rotational position of the sub-reflector 1*b*. This digital output, comprising 4 bit output lines 40*a*–40*d* in order of significance, is connected as the control input 41*c* of an analogue multiplexer device 41 (such as the 4067B CMOS 16-channel analogue multiplexer/demultiplexer device). Such a device comprises a single input line 41*a* receiving an analogue input signal and a plurality (eg 16) of output line 41*b* each selectively connectable to the input line 41*a* on the application of a corresponding multi-bit digital word to the control input lines 41*c* of the multiplexer 41. A further output line from the phase locked loop 39*a* at the phase locked loop frequency is connected to enable and disable the analogue multiplexer 41 at a rate of 200 HZ, so as to reduce (by half) the time during which the multiplexer passes the signal to 2.5 milliseconds and consequently enable a higher sampling accuracy.

The input line 41*a* of the analogue multiplexer 41 is connected to the signal detector 2 of the antenna to receive a signal indicative of the signal strength received by the antenna. During each rotation of the sub-reflector 1*b*, therefore, this signal is selectively switched successively to each of the outputs 41*b* of the analogue multiplexer 41.

A plurality (in this case, 4) of sample and hold circuits 42*a*–42*d* are connected to spaced output lines of the analogue multiplexer 41. In a preferred arrangement, pairs of sample and hold circuits 42*a*, 42*c*; 42*b*, 42*d* are connected to multiplexer output line separated by half a revolution one from the other. In a particularly preferred arrangement, the rotational spacing between the sample and hold circuits is equal.

Each sample and hold circuit may comprise a simple feedback amplifier storing charge upon an associated input storage capacitor during a period of 2.5 milliseconds in which the signal from the detector 2 is routed to that sample and hold circuit, and retaining the stored charge for the remaining 77.5 milliseconds of the rotational cycle thereafter. The circuit comprising the analog multiplexer 41*a*, associated input resistor 41*d*, and sampling capacitors provides a Commutating Analogue bandpass filter which, in known fashion, sharply attenuates frequencies not near the scan frequency or harmonics thereof.

The output of each sample and hold circuit therefore represents the signal strength sensed by the detector 2 at a respective antenna inclination angle relative to the satellite. The misalignment between the antenna and the satellite is thus determined by combining the sample and hold circuit outputs.

Figure 10B:
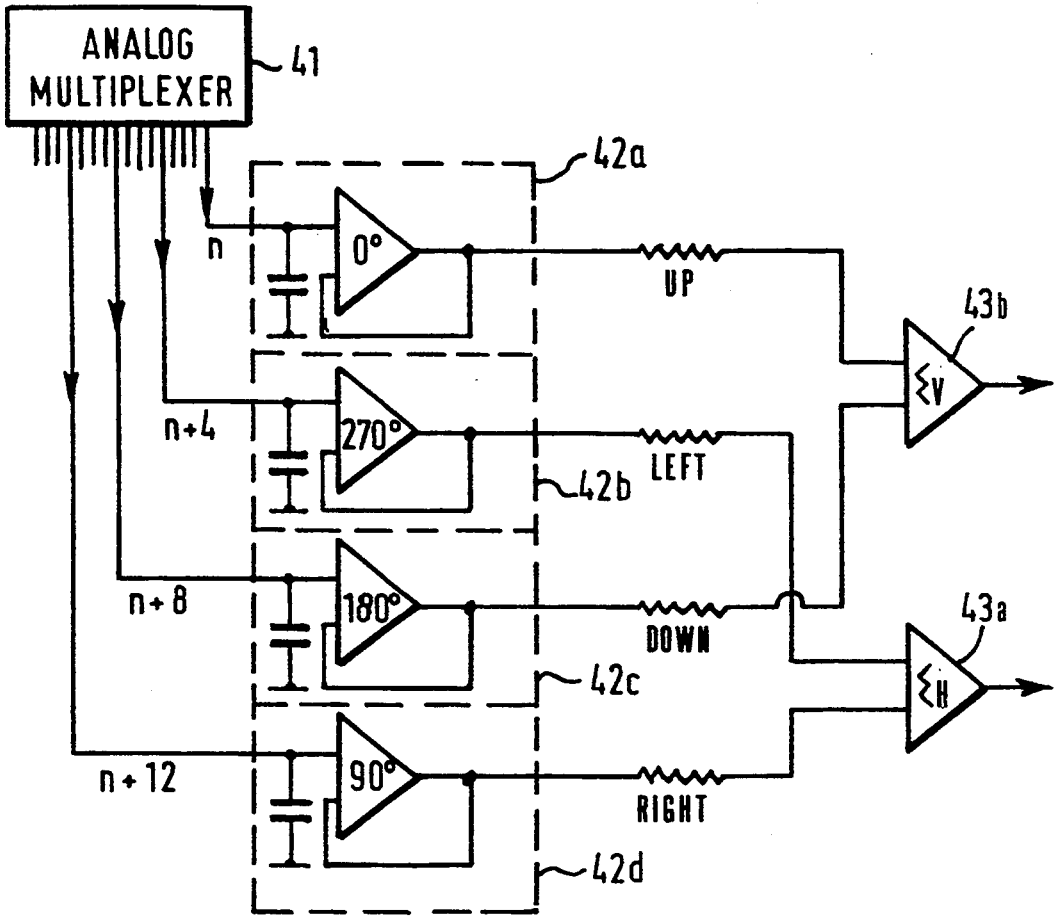
FIG. 10*b* shows an alternative arrangement of part of the circuit of FIG. 10*a;*

Referring briefly to FIG. 10*b*, in one simple arrangement, the sample and hold circuits corresponding to points separated by 180 degrees are subtracted by a pair of differential amplifiers 43*a*, 43*b* to provide respective error output signals. If the antenna is optimally aligned with the satellite, the signal strength received will be equal throughout the rotational cycle and the outputs of the differential amplifiers 43*a*, 43*b* will correspondingly be zero; in any other orientation of the antenna, the error signals will represent in two orthogonal axes the magnitude of mis-alignment of the antenna.

Where, as preferred, the rotational speed of the sub-reflector is an even multiple of the frequency of any modulation of the signal received and/or any electrical interference present, identical modulation and/or interference levels will appear at alignment positions separated by 180 degrees, and consequently at both inputs to each differential amplifier 43*a*, 43*a* so as to be cancelled by the differential amplifiers from the error signal outputs.

Since each sample and hold circuit 32*a*–32*d* is refreshed with a new signal once per revolution (for 12.5 hertz, once every 80 milliseconds), the output of the corresponding differential amplifiers 43*a*, 43*b* of FIG. 10*b* changes twice per revolution (ie every 40 milliseconds). In some applications, it may be desirable to update the error signal more frequently than this.

referring once more to FIG. 10*a*, in a preferred embodiment of the invention, the outputs of the 4 sample and hold circuits 42*a*–42*d* are connected each to one of its immediate neighbours. The sample and hold circuits 42*a*–42*d* are connected to output lines of the analogue multiplexer 41 selected such that they correspond to antenna inclinations at 45 degrees to the inclinations (eg horizontal and vertical) in which the antenna is steerable or to which the error signals generated correspond.

Each differential amplifier 43*a*, 43*b* therefore generates a signal responsive to the difference between the sums of corresponding opposed sample and hold circuits, so as to generate, as before, a pair of orthogonal error signals but since each error signal is now responsive to the outputs of all four sample and hold circuits 42*a*–42*d* its value changes four times each rotation of the sub-reflector 1*b* (or 20 milliseconds) so that the antenna responds quicker to mis-alignment.

It will of course be apparent that other arrangements of sample and hold circuits could equally be used to generate a pair of error signals, which need not themselves correspond to an orthogonal axis.

Figure 11:
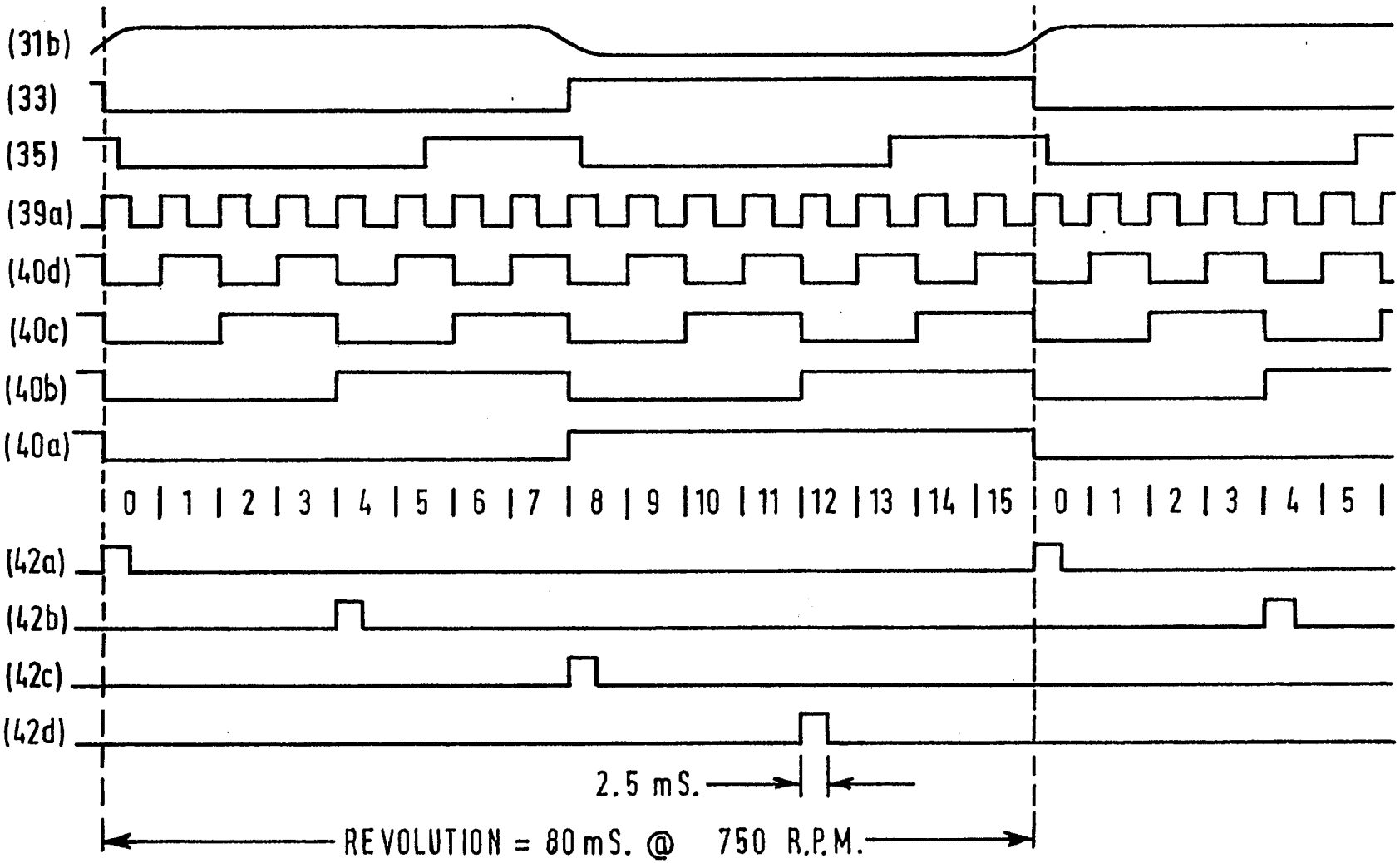
FIG. 11 shows wave forms produced at points of the circuit of FIG. 10*a;*

FIG. 11 illustrates the waveform outputs of the components of FIG. 10*a*.

It is important that the rotational positions which the sample and hold circuits operate (or, to be more precise, positions at which the sample and hold circuits stop sampling and start holding), relative to the vertical axis of the antenna, should be aligned to allow for any phase lag or other delays introduced within the position determining system. If the antenna is not properly aligned, mis-alignment in one axis will lead to correction in a different axis so that the antenna does not properly track the satellite.

In the above embodiment, alignment may be performed by manually aligning the antenna directly on a satellite or other signal source, and then elevating the antenna to introduce a vertical error but no horizontal error. The adhesive reflective strip 31*c* the sub-reflector 1*b* is then moved, whilst observing the vertical and horizontal error signal outputs on an oscilliscope, until the horizontal error signal output is eactly zero volts. Once a first antenna has been aligned, a second antenna of identical construction should not require separate alignment or calibration.

ANTENNA POSITION CONTROL

Figure 12:
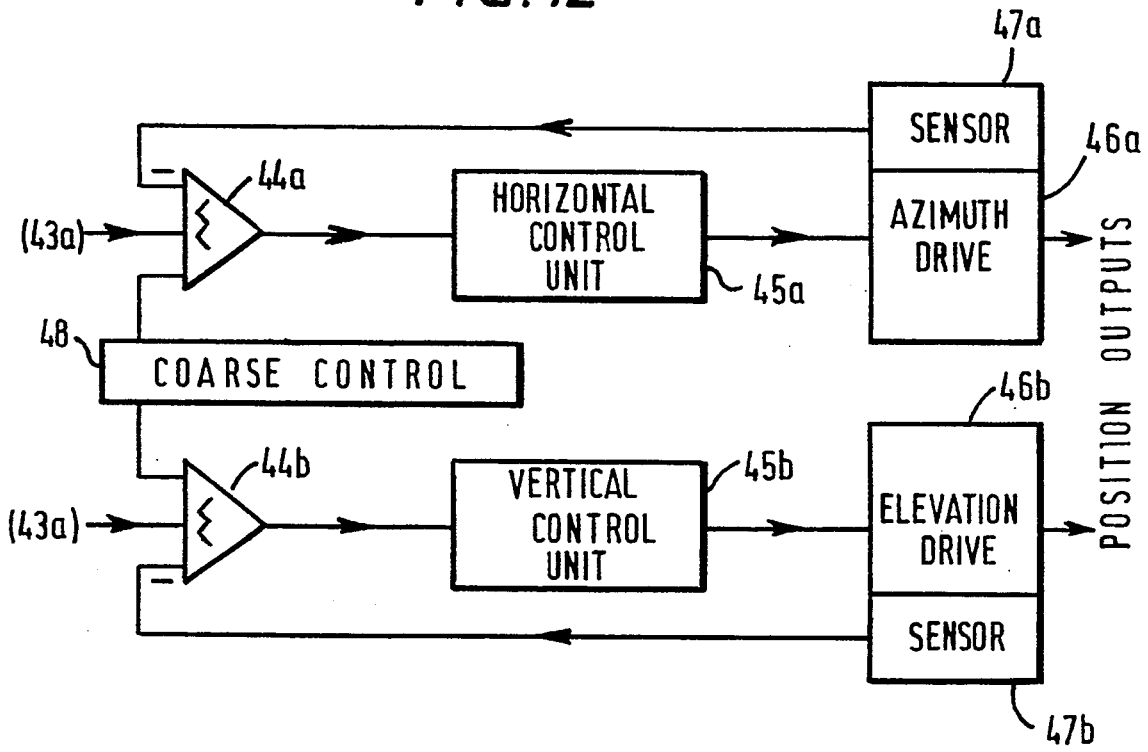
FIG. 12 shows schematically the position control system of the antenna according to one embodiment of the invention.

Referring to FIG. 12, the antenna position control drive 5 shown in FIG. 2 will now be discussed in greater detail. The error signals from the differential amplifiers 43*a*, 43*b* are connected to respective summing nodes 44*a*, 44*b* (comprising, for example, operational amplifiers). The respective outputs of the summing nodes 44*a*, 44*b* are connected as inputs to a pair of drive control units 45*a*, 45*b* supply respective output power levels to a pair of drive units 46*a*, 46*b* connected to physically move the antenna 1 in different directions.

Preferably, the drive units are arranged to move the antenna 1 in orthogonal directions; conveniently, they comprise a horizontal or azimuth drive 46*a* arranged to rotate the antenna in a horizontal plane and a vertical or elevation drive 46*b* arranged to rotate the antenna in a vertical plane. Conveniently, both drive units 46*a*, 46*b* are electrically powered motors; conveniently DC motors. The motors are arranged to run at a relatively high rotational speed (up to 1000–2000 rpm) for accuracy, and the drive units 46*a*, 46*b* in this case further comprise reduction gears (for example reducing the rotational speed by a ratio of 240), connected to respective vertical and horizontal rotation axes on the antenna 1.

Figure 15:
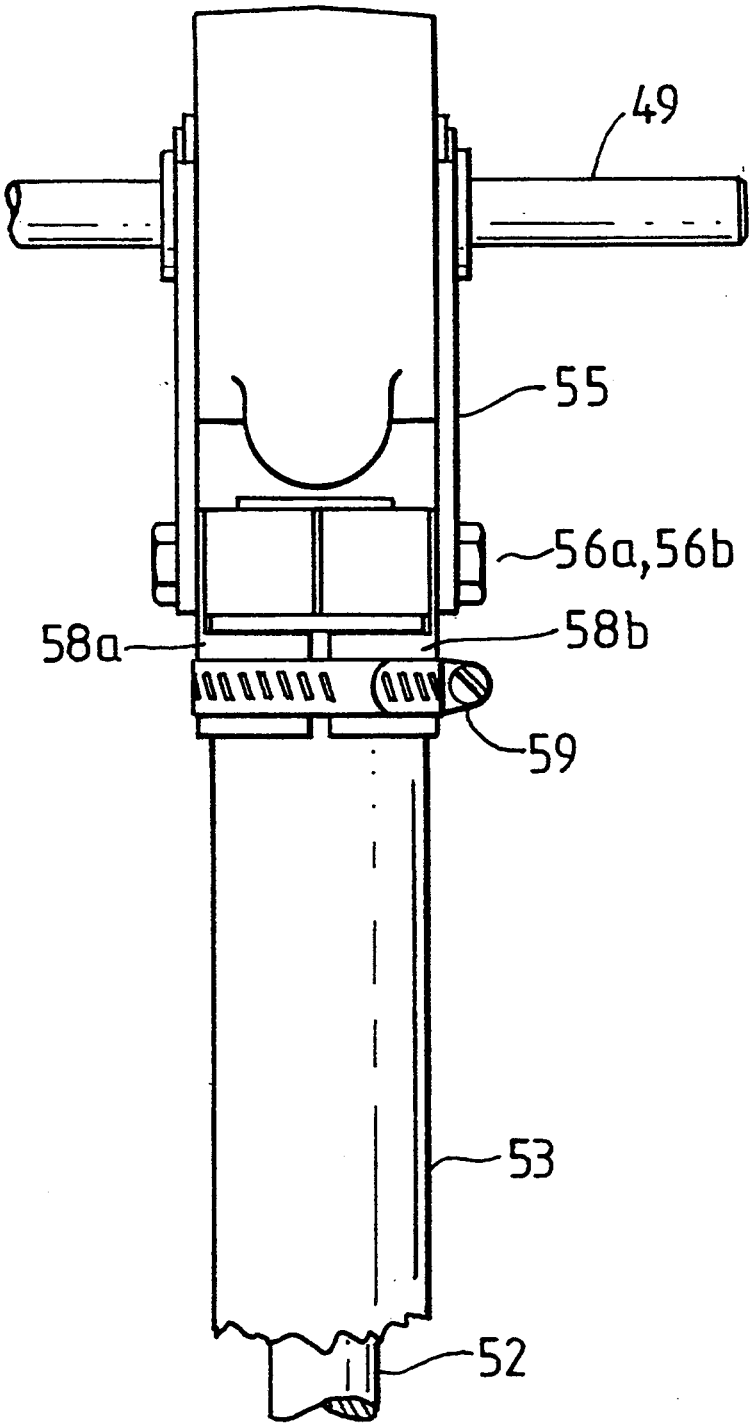
FIG. 15 shows a corresponding front elevation.

The horizontal and vertical control units 45*a*, 45*b* each comprise a switch mode DC power supply, delivering a motor drive current proportional to the control signal from the respective summing nodes 44*a*, 44*b* to the corresponding drive motors 46*a*, 46*b*. The drive current comprises a DC supply pulsed at approximately 20 kilohertz, the pulse width being controlled to determine the motor current. One suitable control unit 45 comprises the L292 motor driver integrated circuit device supplied by SGS, connected as shown in FIG. 15 (page 36) of "A designers guide to the L290/2L291/L292 DC motor speed/position control system", Power Linear Actuators Databook - 2nd Edition, Jan 84.

Associated with each drive unit 46*a*, 46*b* is a velocity sensor 47*a*, 47*b* mounted to sense the rotational speed of the motor. The motor speed signal generated by the sensor 47 is fed back and subtracted at the respective summing node 44*a*, 44*b*. Conveniently the velocity sensor comprises an optical encoder comprising a light source, a light sensor and a rotating disc including a plurality of radially distributed reflective or transmissive elements arranged to modulate the light path between the sensor and the source, together with a frequency to voltage converter which converts the output of the sensor into a voltage level supplied to the respective summing node 44*a* or 44*b*. One suitable arrangement is the L290 integrated circuit described in the above referenced publication connected to the output of the Radio Spares Shaft Encoder Kit No. 631-532, described in Radio Spares Data Sheets 9394 (March 1989). This arrangement uses two phase-related outputs of the encoder to provide a bipolar, dependent, voltage level.

It will thus be seen that when a significant mis-alignment voltage appears at a summing node 44, the respective control unit 45 generates a significant motor drive current supplied to the drive unit 46 which correspondingly rotates the antenna to reduce the mis-alignment. As the rotational speed of the motor rises, the output of the sensor 47 also rises, causing the output of the summing node 44 to decrease and the motor drive current to decrease to a level sufficient to maintain a speed corresponding to the misalignment voltage. When alignment is reached, the error voltage applied to the node 44 from the preceding differential amplifier 43 becomes insignificant but the output of the sensor 47 remains high and therefore the control voltage supplied to the control unit 45 becomes negative, decelerating the motor 46 rapidly, so the output of the sensor 47 falls towards zero and the motor 46 stops.

This arrangement allows a very widely variable motor speed control permitting high accuracy and rapid response of antenna positioning.

Referring to FIG. 12, also provided at the summing nodes 44*a*, 44*b* are a pair of lines from a coarse alignment control unit 48 provided to allow the antenna to be initially positioned to point towards the satellite; for example this may comprise manual elevation and azimuth controls each comprising a manually variable potentiometer connected to a voltage source, to allow a user to manually align the antenna by variation of the potentiometers.

The elevation of a satellite will vary between nought and 90° from the horizontal, and accordingly, the course control elevation potentiometer should be variable over, say, five volts corresponding to a range of 0°-90° from the horizontal. The azimuth of a satellite can vary 360° degrees depending upon the alignment of the vessel or other item upon which the antenna is mounted, and accordingly, the azimuth course control potentiometer should have a maximum range corresponding to at least 360° and preferably 720°.

Instead of manually aligning the antenna, it would instead be possible to supply store signals corresponding to predetermined inclinations to the coarse control unit 48.

The signal supplied by the potentiometers acts to control the azimuth and elevation drives in an equivalent manner to that in which the error signals do so, as described above.

Advantageously, the azimuth and elevation drives 46*a*, 46*b* are also arranged to generate azimuth and elevation position outputs (these may be generated by potentiometers or the velocity sensors 47*a*, 47*b*) which may be used, for example, to stabilize other ship borne machinery.

MECHANICAL ARRANGEMENT

Figure 13:
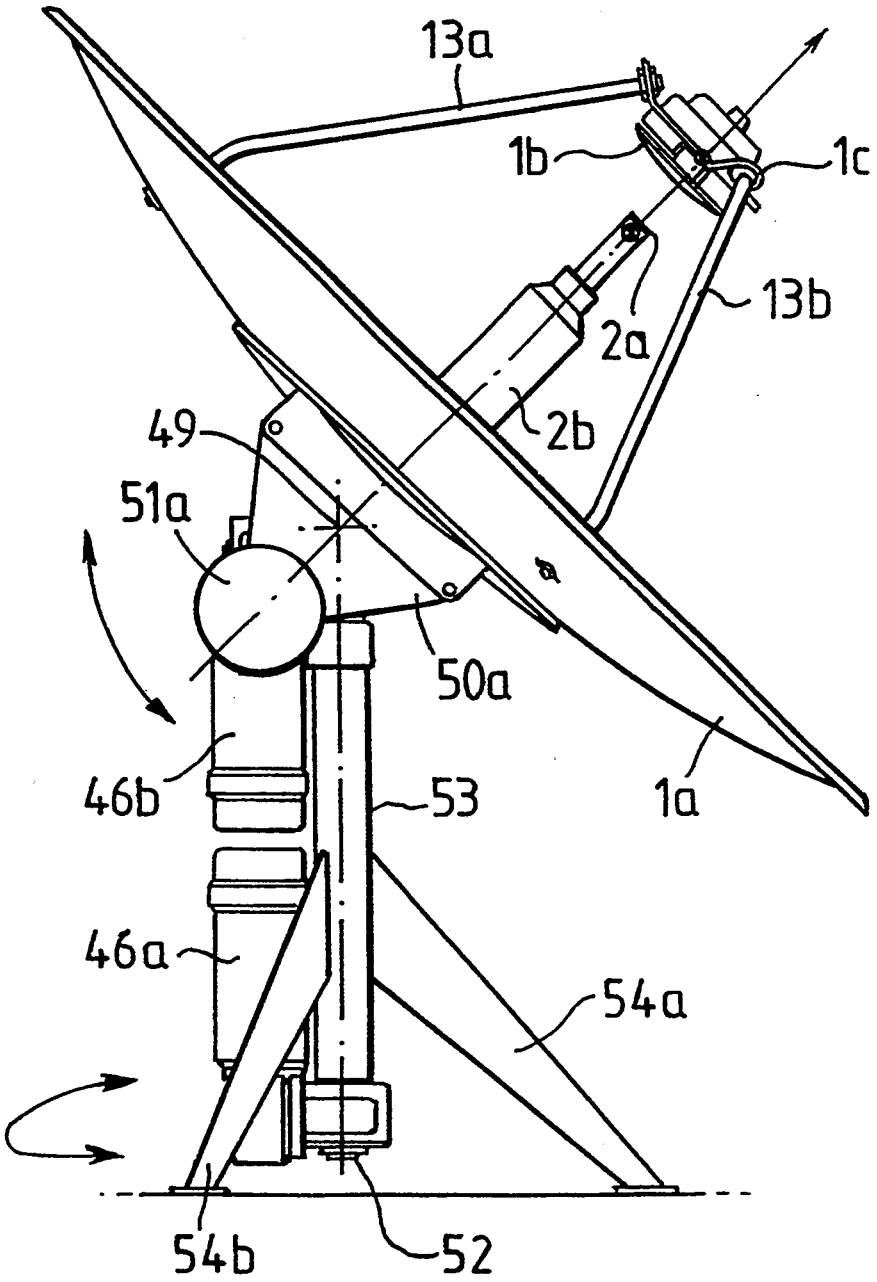
FIG. 13 shows schematically the external appearance of an antenna according to one embodiment of the invention.
Figure 14:
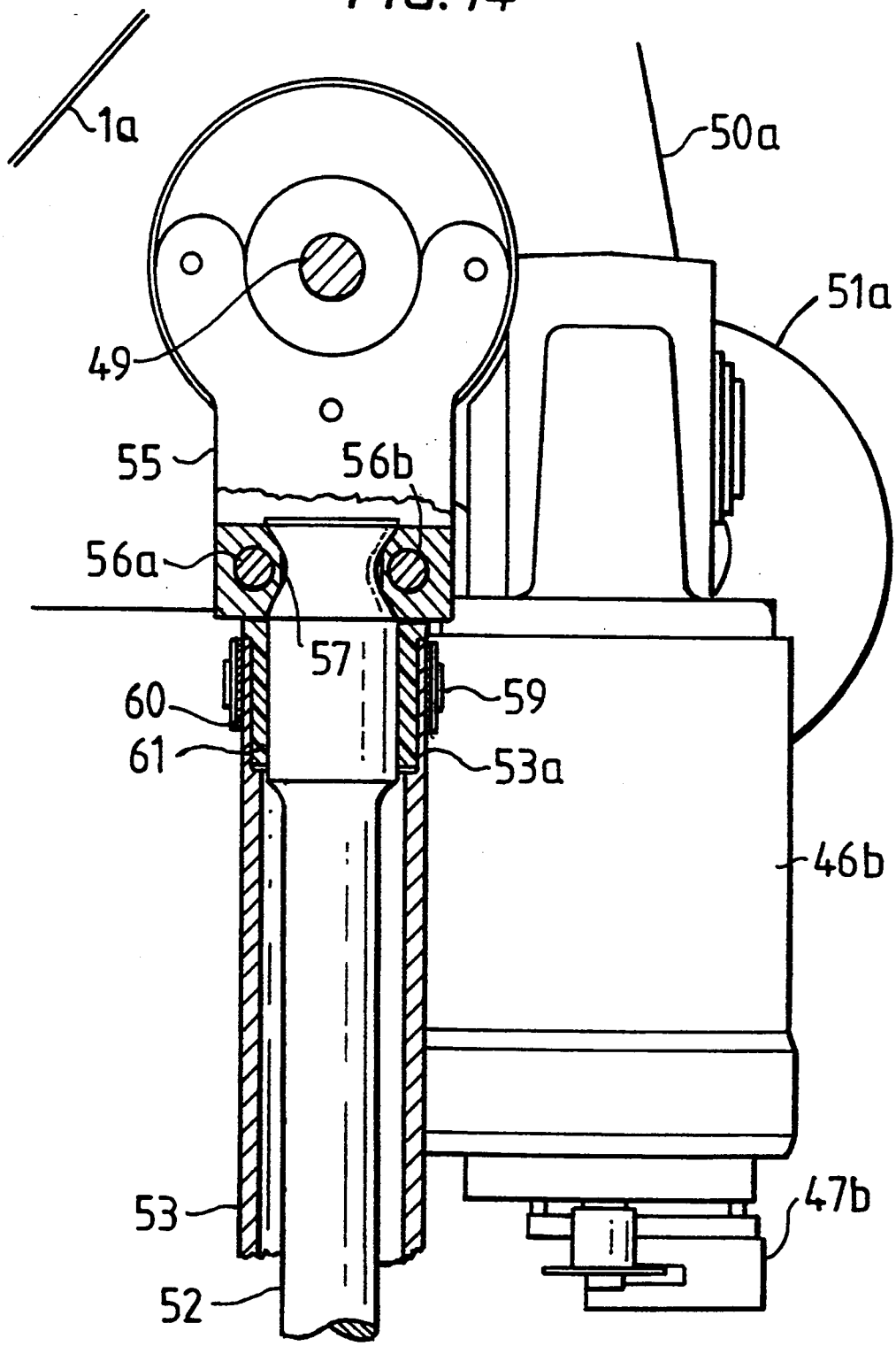
FIG. 14 shows schematically a semi-sectional side elevation through the upper part of FIG. 13.

Referring to FIGS. 13 and 14, the antenna 1 is mounted on a horizontal pivot axle 49 by a pair of brackets 51*a*, 51*b* each carrying a weight 51, 51*a* which in combination counter balance the weight of the antenna 1. The horizontal axle 49 passes through a vertical axle 52 carried within a vertical outer sleeve 53 supported by a tripod comprising legs 54*a*, 54*b*, and a third leg (not shown). The azimuth drive 46*a* is mounted to the outer sleeve 53, and comprises a DC electric motor connected through two consecutive worm and screw gear boxes having reduction ratios of 20 and 12 to the inner vertical axle 52 so as to rotate the antenna 1 about the vertical axle 52. The elevation drive unit 46*b* may be essentially identical to the azimuth drive unit 46*a*, and is mounted through similar reduction gears to the horizontal axle 49 so as to pivot the antenna 1 about that axle. It is mounted so as to rotate with the antenna 1 (50*a*, 50*b*) around the vertical axle 52 when driven by the azimuth drive unit 46*a*.

Referring to FIGS. 14 and 15, the horizontal pivot axle 49 is mounted in a yoke 55 which comprises a pair of parallel plates bolted together, each plate including a semi-circular recess carrying the bearing for the axle 49. In order to prevent damage to the reduction gears in the event that movement of the antenna is obstructed or jammed, both the elevation and azimuth drive units 46*a*, 46*b* are mounted by their shafts to the antenna to allow slippage. As shown in FIG. 14, the axle 52 pivotting the antenna in azimuth is connected to the yoke 55 by a clamp comprising the two halves of the yoke 55 bolted by bolts 56*a*, 56*b* tightly around a recessed portion 57 at the top of the vertical axial 52. A similar clamp is provided on the other axle 49.

Due to the unavoidable manufacturing tolerances, backlash can occur in the reduction gear system making it difficult to rapidly halt the antenna and leading to unwanted vibration and instability on the drive system. Accordingly, a brake is provided, acting against rotation in azimuth. Referring to FIG. 15, the brake may comprise a split cylinder 58 consisting of a pair thin metal half shells 58*a*, 58*b* rigidly connected to the yoke 55 to rotate therewith, and clamped around the tube 53 (which is of reduced thickness at this point 53*a*) by a clamp exerting circumferential compression (eg, a hose or Jubilee clamp 59). Between the tube 53*a* and the shells 58*a*, 58*b* is a brake lining ring 60, comprising a material having an essentially constant co-efficient of static and dynamic friction (for example a strip of tape coated with Teflon (TM)). The brake assembly 53*a*, 60, 58, 59 thus acts to damp backlash.

The bearing within which the shaft 52 rotates is provided by a bush 61 of low friction material (preferably a ring of Teflon (TM)). It is important that the tube 53, vertical axle 52, legs 54 and mounting bush 61 should all be structurally rigid and without play or looseness, and that the antenna shall be rigidly mounted, or the tracking system can cause the antenna to vibrate.

To avoid backlash in the elevation drive system, the counter balance weights 51*a*, 51*b* do not quite balance the dish 1*a* so that the antenna is slightly "nose heavy".

In use, the legs 54*a*, 54*b* and third leg are bolted to the deck of a water vessel. Preferably, the antenna 1 is protected by a radome or hood transparent to radio frequencies.

In one embodiment, the sub-reflector is rotated at 50 revolutions per second. Any 50 Hz mains supply ripple manifests as a minor, constant offset alignment error. The 25 Hz triangular signal appears as an opposite error on alternate cycles, filtered out by averaging the output signal over two or more rotations.

I claim:

1. A rotary speed control system for controlling rotation of a rotatable component rotated at a rotary speed comprising:

rotary position signal generator means for generating a periodically varying signal having an average level related to the rotary speed, reference signal generator means for generating a corresponding reference signal, comparator means for generating an output corresponding to a difference between said periodically varying signal and said reference signal, such that said comparator means generates a pulsed output having a width which is modulated to stabilize said rotary speed when the rotary speed approximates a desired speed, and said comparator output remains constant to adjust said rotary speed when said rotary speed diverges substantially from said desired speed.

2. A speed control system according to claim 1 in which the reference signal generator means and the rotary position signal generator means each comprise a tachometer device connected to respective periodically varying signal sources.

3. An antenna system comprising an antenna having a beam, including a component connected to be rotated by apparatus according to claim 2 to scan the beam.

4. A marine satellite television receiver antenna system for use on a marine vessel, comprising:

a receiver antenna having a main reception direction, the receiver antenna comprising a rotatable components, means for rotating said rotatable component so as to rotate said main reception direction in a conical scan, means for scanning the main reception direction of the receiver antenna, means for measuring the signal strength of a signal received from the antenna during a scan to produce a measurement signal, said means for measuring including sampling means for sampling the signal received by said antenna at spaced points in said scan to produce signal samples and for generating said measurement signal in dependence upon a difference between said signal samples from different said spaced points, and means for varying the alignment of the antenna to maintain orientation with a satellite based on the measurement signal.

5. An antenna system according to claim 4 further comprising rotary position detecting means for sensing the position of said rotatable component.

6. An antenna system according to claim 5, in which the rotary position detecting means comprises a radiation detector responsive to radiation modulated by a positional feature on said component, and said sampling means are controlled in response to said rotary position detecting means.

7. An antenna system according to claim 5, comprising interpolation means responsive to said rotary position detecting means to produce a plurality of sampling position signals, corresponding to said spaced points.

8. An antenna system according to claim 5, in which said spaced points comprise at least one pair of points mutually in anti-phase relationship in said scan, and further comprising antenna position signal generating means responsive to a difference between the signal sample at the points comprising said at least one pair.

9. An antenna system according to claim 8, in which said sampling means are arranged to sample at points comprising a plurality of said pairs, and the position signal generating means are responsive to a sum of signal levels at sampling points adjacent within said scan.

10. An antenna system according to claim 8, in which the antenna is scanned at a scan rate comprising scan rate control means for maintaining the scan rate, said control means comprising means responsive to a rotational position of said rotatable component for producing a rotational position signal, and means for rotating said rotatable component in dependence upon said rotational position signal to maintain said scan rate substantially constant, and the sampling means are arranged to sample the rotational position signal at points comprising two orthogonally disposed pairs, and said antenna position signal generating means produces an antenna position signal comprising two output signals representing orthogonal alignment axes, each output signal being derived in dependence upon one said pair.

11. A satellite television receiver antenna system comprising:

a receiver antenna having a main reception direction, said receiver antenna comprising a rotatable component for scanning the main reception direction of the receiver antenna at a scan rate, means for measuring a signal strength of a signal received from the antenna during a scan to produce a measurement signal, means for varying the alignment of the antenna to maintain orientation with a satellite based on the measurement signal, and scan rate control means for maintaining the scan rate, said scan rate control means comprising sensor means responsive to a rotational position of said rotatable component for producing a sensor signal, and rotating means for rotating said rotatable component in dependence upon said sensor signal to maintain said scan rate substantially constant, said rotating means comprising a motor, a pulse controlled power supply and supply means for supplying power control pulses to said pulse controlled power supply, said supply means comprising means for deriving, from the sensor signal of the sensor means, at least one pulse within each rotation of said rotatable component having a width which increases in dependence upon a rotary period of said rotatable component, so as to increase the power supplied when rotary speed of said rotatable component decreases.

12. A satellite television receiver antenna system for use on a vehicle, comprising:

a receiver antenna having a main reception direction, the receiver antenna comprising a rotatable component, means for rotating said rotatable component so as to rotate said main reception direction in a conical scan, rotary position detecting means for sensing first positions of said rotatable component, sampling means for sampling a signal received by said antenna at spaced points in said scan to produce signal samples, and interpolation means responsive to said rotary position detecting means to produce a plurality of sampling position signals corresponding to said spaced points at second positions between said first positions.

* * * * *